US008422931B2

(12) United States Patent
Van Bortel et al.

(10) Patent No.: US 8,422,931 B2
(45) Date of Patent: Apr. 16, 2013

(54) APPARATUS AND METHOD FOR DETECTING THE TRAVEL DIRECTION OF MEDIA IN A MEDIA PATH IN AN IMAGE MARKING AND FUSING SYSTEM

(75) Inventors: David P. Van Bortel, Victor, NY (US); Brian J. McNamee, Brockport, NY (US)

(73) Assignee: Xerox Corporation, Norwalk, CT (US)

( * ) Notice: Subject to any disclaimer, the term of this patent is extended or adjusted under 35 U.S.C. 154(b) by 1040 days.

(21) Appl. No.: 12/208,785

(22) Filed: Sep. 11, 2008

(65) Prior Publication Data

US 2010/0061786 A1 Mar. 11, 2010

(51) Int. Cl.
*G03G 15/00* (2006.01)
*G03G 15/20* (2006.01)

(52) U.S. Cl.
USPC ..... 399/395; 399/67; 399/68; 399/122; 399/400

(58) Field of Classification Search ..... 399/67, 399/68, 69, 122, 324, 395, 400, 332, 337
See application file for complete search history.

(56) References Cited

U.S. PATENT DOCUMENTS

| | | | | |
|---|---|---|---|---|
| 4,789,877 | A * | 12/1988 | Izaki | 399/339 |
| 5,337,133 | A | 8/1994 | Siegel et al. | |
| 6,246,858 | B1 * | 6/2001 | Condello et al. | 399/329 |
| 7,003,258 | B2 | 2/2006 | Adachi et al. | |
| 7,303,191 | B2 * | 12/2007 | Takagi et al. | 271/227 |
| 7,596,334 | B2 * | 9/2009 | Yoshino et al. | 399/67 |
| 2007/0047989 | A1 * | 3/2007 | Nakamura et al. | 399/67 |

OTHER PUBLICATIONS

Marshall Brain and Carmen Carmack; How Stuff Works; "How Computer Mice Work", http://www.howstuffworks.com/mouse.htm/printable; pp. 1-10, Jun. 18, 2008.

Philips; Press Information, "White Paper: Interfacing A 2.4GHz Transceiver to a Philips Twin-Eye Laser Sensor"; http://www.business-sites.philips.com/lasersensors/about/article-15031.html; pp. 1-7, Feb. 27, 2006.

* cited by examiner

*Primary Examiner* — Matthew G Marini
(74) *Attorney, Agent, or Firm* — Ronald E. Prass, Jr.; Prass LLP

(57) ABSTRACT

An apparatus (100) and method (500) that detects the travel direction of media in a media path in an image marking and fusing system is disclosed. The apparatus can include a media transport (110) configured to transport media. The apparatus can include a media marking engine (120) coupled to the media transport, the media marking engine configured to mark an image on media transported by the media transport to create unfused marked media (115). The apparatus can include a fusing member (130) coupled to the media transport, the fusing member having an axis of rotation (132), the fusing member configured to fuse the image on the media. The apparatus can include a media motion sensor (140) configured to sense travel information based on an unfused marked media travel direction (116) and configured to output a media motion sensor signal corresponding to the travel information. The apparatus can include a controller (150) coupled to the media motion sensor, the controller configured to output an alignment angle signal in response to receiving the media motion sensor signal, the alignment angle signal corresponding to an alignment angle between the fusing member axis of rotation and the unfused marked media travel direction.

8 Claims, 7 Drawing Sheets

APPARATUS AND METHOD FOR DETECTING THE TRAVEL DIRECTION OF MEDIA IN A MEDIA PATH IN AN IMAGE MARKING AND FUSING SYSTEM

BACKGROUND

Disclosed herein is an apparatus and method that detects the travel direction of media in a media path in an image marking and fusing system that marks images onto print media substrates and fuses or fixes marked images onto the print media substrates.

Presently, in a typical electrophotographic printing process, a photoconductive member in a media marking engine is charged to a substantially uniform potential to sensitize a surface of the photoconductive member. The charged portion of the photoconductive member is exposed to a light image of an original document being reproduced. Exposure of the charged photoconductive member selectively dissipates the charges on the photoconductive member in irradiated areas. This process records an electrostatic latent image on the photoconductive member corresponding to informational areas contained within the original document. After the electrostatic latent image is recorded on the photoconductive member, the latent image is developed by bringing a developer material into contact with the photoconductive member. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to media to generate unfused marked media. The media can include paper, a transparency, a substrate, or any other media.

After the media marking engine marks the media with the toner powder image, a fuser heats the toner particles to fuse the toner powder image to the media. While the fuser may take many forms, where heat or combination heat-pressure fusers are currently most common. One combination heat-pressure fuser includes a heat fusing roll in physical contact with a pressure roll. These rolls cooperate to form a fusing nip through which the unfused marked media passes. As the media passes through the rolls, heat and pressure fuses the powder image to the media.

Unfortunately, the unfused marked media may not travel in a media path at a desired angle from the media marking engine to the fuser. This can cause problems, such as edge wear, which is a critical problem in roll and belt fusing systems, such as in viton over silicone systems, Teflon over silicone systems, and other fusing systems. Edge wear can be the result of roller surface properties, the nature of media paper edges, the misalignment of media sheets as they pass through a fusing nip, and other properties. For example, shear stress is placed upon roller surfaces and paper surfaces when the surfaces conform around the edge of the media when it is in the fusing nip. Furthermore, if the media is not perfectly square to the rotation of the roll surface, a cutting or wiping action will occur. The cutting action exacerbates the wear of the roller surface and causes a resulting differential gloss and color differential on the media.

As a further example, in most conventional printing systems, the fuser is located in a machine frame on pins or slides that affect alignment control between the fuser roll axis and a machine paper path. In the fixed pinned system the misalignment between media motion and fuser roll axis is usually consistent, which results in more wear on one end of the fuser roll then the other. This is generally thought to be the side with the cutting motion. In slide systems the wear can be at either end depending upon the float of the system.

Furthermore, since the travel path of the media is dependent upon the skew adjustment performed at paper registration prior to marking, subsequent contact, transfer, stripping and transport alignments during marking and prior to fusing result in skew of the media travel direction. The skew of the media travel direction causes resulting issues of edge wear, cutting, wiping, gloss differential, and color differential mentioned above. These issues are especially problematic because current systems cannot detect the travel direction of unfused marked media.

Thus, there is a need for apparatus and method that detects the travel direction of media in a media path in an image marking and fusing system.

SUMMARY

An apparatus and method that detects the travel direction of media in a media path in an image marking and fusing system is disclosed. The apparatus can include a media transport configured to transport media. The apparatus can include a media marking engine coupled to the media transport, the media marking engine configured to mark an image on media transported by the media transport to create unfused marked media. The apparatus can include a fusing member coupled to the media transport, the fusing member having an axis of rotation, the fusing member configured to fuse the image on the media. The apparatus can include a media motion sensor configured to sense travel information based on an unfused marked media travel direction and configured to output a media motion sensor signal corresponding to the travel information. The apparatus can include a controller coupled to the media motion sensor, the controller configured to output an alignment angle signal in response to receiving the media motion sensor signal, the alignment angle signal corresponding to an alignment angle between the fusing member axis of rotation and the unfused marked media travel direction.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
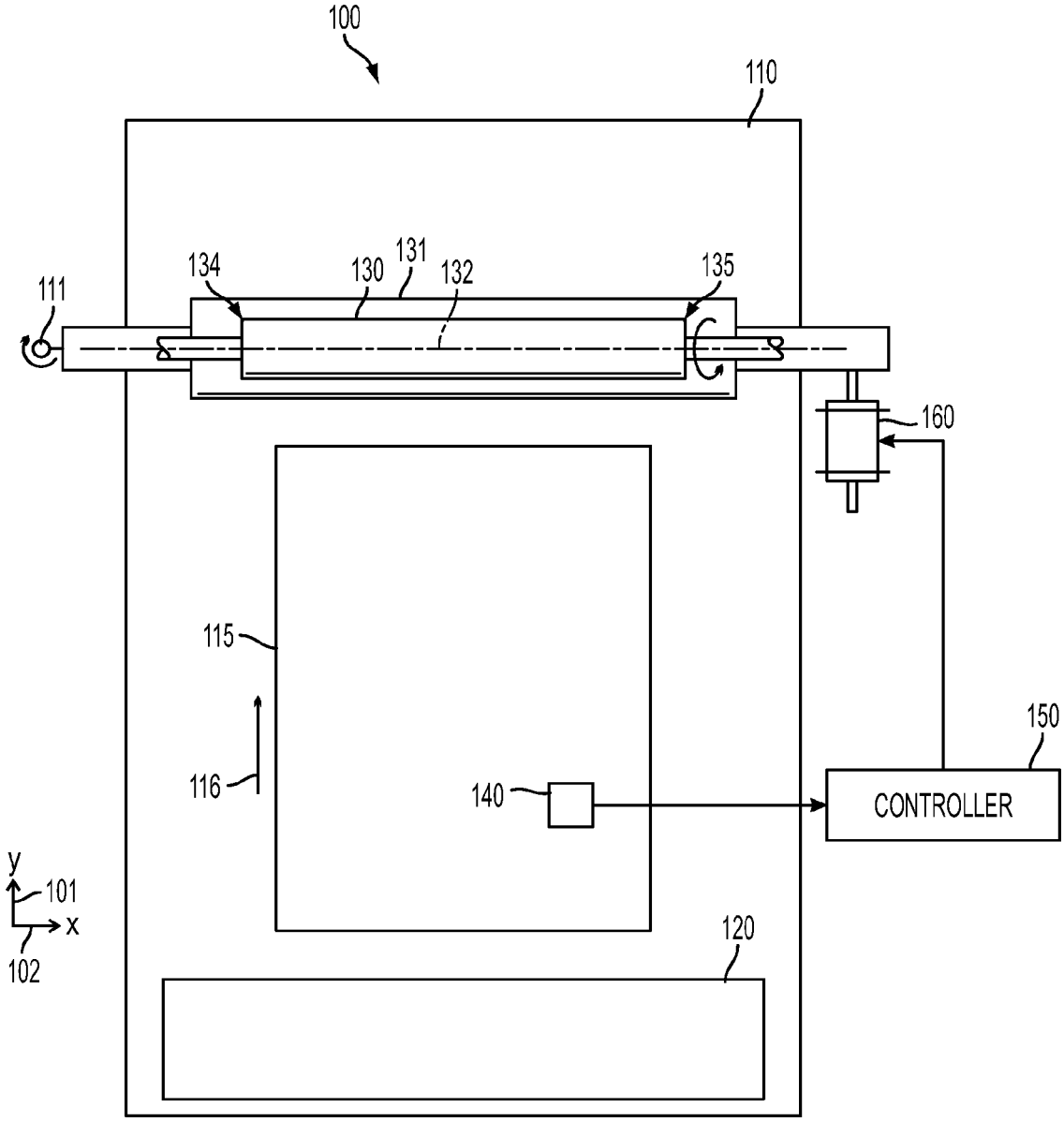
FIG. 1 is an exemplary illustration of an apparatus.

The embodiments include an apparatus for detecting the travel direction of media in a media path. The apparatus can include a media transport configured to transport media. The apparatus can include a media marking engine coupled to the media transport, the media marking engine configured to mark an image on media transported by the media transport to create unfused marked media. The apparatus can include a fusing member coupled to the media transport, the fusing member having an axis of rotation, the fusing member configured to fuse the image on the media. The apparatus can include a media motion sensor configured to sense travel information based on an unfused marked media travel direction and configured to output a media motion sensor signal corresponding to the travel information. The apparatus can include a controller coupled to the media motion sensor, the controller configured to output an alignment angle signal in response to receiving the media motion sensor signal, the alignment angle signal corresponding to an alignment angle between the fusing member axis of rotation and the unfused marked media travel direction.

The embodiments further include an apparatus for detecting the travel direction of media in a media path. The apparatus can include a media transport configured to transport media in a travel direction substantially along a y-axis. The apparatus can include a media marking engine coupled to the media transport, the media marking engine configured to mark an image on media transported by the media transport to create unfused marked media. The apparatus can include a fusing member coupled to the media transport, the fusing member having an axis of rotation substantially parallel to an x-axis perpendicular to the y-axis, the fusing member including a rotating cylinder, the fusing member configured to fuse the image on the media. The apparatus can include a media motion sensor configured to sense x-axis and y-axis travel information of unfused marked media and configured to output a media motion sensor signal corresponding to the x-axis and y-axis travel information of the unfused marked media. The apparatus can include a controller coupled to the media motion sensor, the controller configured to adjust an alignment angle between the fusing member axis of rotation and the unfused marked media travel direction based on the media motion sensor signal.

The embodiments further include method for detecting the travel direction of media in an apparatus having a media transport, a media marking engine, and a fusing member having an axis of rotation, the apparatus also including a media motion sensor and a controller. The method can include transporting media in the media transport and marking, with the media marking engine, an image on the media transported in the media transport to create unfused marked media. The method can include sensing, using the media motion sensor, travel information of the unfused marked media. The method can include sending a media motion sensor signal to the controller, the media motion sensor signal corresponding to the unfused marked media travel information. The method can include outputting, with the controller, an alignment angle signal in response to receiving the media motion sensor signal, the alignment angle signal corresponding to an alignment angle between the fusing member axis of rotation and the unfused marked media travel direction. The method can include fusing, using the fusing member, the image on the media.

FIG. 1 is an exemplary illustration of an apparatus 100. The apparatus 100 may be a printer, a multifunction media device, a xerographic machine, or any other device that transports and fuses an image onto media. The apparatus 100 can include a media transport 110, a media marking engine 120 coupled to the media transport 110, a fusing member 130 coupled to the media transport 110, a media motion sensor 140, and a controller 150 coupled to the media motion sensor 140. Portions of the controller 150 operation can be contained in one element or can be distributed throughout the apparatus 100. The fusing member 130 can have an axis of rotation 132, a first end 134, and a second end 135. The fusing member 130 can include or be part of a fusing assembly 131. The fusing member 130 can be coupled to a pivot point 111 coupled to the fusing member first end 134. The apparatus 100 can also include a prime mover 160 coupled to the fusing member 130 and coupled to the controller 150. The prime mover 160 can be coupled to the fusing member second end 135.

In operation, the media transport 110 can be configured to transport media. The media marking engine 120 can be configured to mark an image on media transported by the media transport 110 to create unfused marked media 115. The media marking engine 120 can mark the media using xerographic marking, ink jet marking, liquid ink marking, or other marking. For example, a toner powder image can be transferred from a photoconductive belt or roll to the media. Unfused marked media 115 can be media marked with an image by the media marking engine 120 that has not yet been fused by the fusing member 130. The unfused marked media 115 may include the unfused image along with an image that has previously been fused in a separate process.

The fusing member 130 can be configured to fuse the image on the media. The fusing member 130 can fuse, dry, and/or fix an image on the marked media. For example, the fusing member 130 can permanently affix a transferred toner powder image onto the media. The fusing member 130 can be a fusing roll, a fusing belt, or other fusing member. For example, a fusing belt can be wrapped around one or more rotating cylinders. The fusing belt can have an axis of rotation based on an arc that the belt creates around the rotating cylinders. Because the unfused marked media travel direction 116 may not be exactly perpendicular to the fusing member axis or rotation 132, the axis of rotation 132 may only be substantially perpendicular the unfused marked media travel direction 116.

The media motion sensor 140 can be configured to sense travel information based on an unfused marked media travel direction 116 and can be configured to output a media motion sensor signal corresponding to the travel information. The controller 150 can be configured to output an alignment angle signal in response to receiving the media motion sensor signal. The alignment angle signal can correspond to an alignment angle between the fusing member axis of rotation 132 and the unfused marked media travel direction 116. The alignment angle signal can correspond to the alignment angle between the fusing member axis of rotation 132 and the unfused marked media travel direction 116 because it can be based on the media motion sensor signal. For example, the controller 150 can use the media motion sensor signal to determine the alignment angle between the fusing member axis of rotation 132 and the unfused marked media travel direction 116. The alignment angle signal can include alignment angle information, can include a control signal used to control elements of the apparatus 100, or can include other information or signals relating an alignment angle. The alignment angle signal is defined to be a signal that corresponds to the alignment angle in that the alignment angle signal is any signal that can be used to display information regarding an angle between the fusing member and the unfused marked media travel direction and/or used to adjust an angle between the fusing member and the unfused marked media travel direction.

For example, the controller 150 can output the alignment angle signal to provide information regarding the media motion sensor signal to an operator who can manually align the fusing member 130 with the unfused marked media travel direction 116 based on the media motion sensor signal. The operator can manually align the fusing member 130 with unfused marked media travel direction 116 by manually adjusting a position of the fusing member 130, by manually adjusting elements of the apparatus 100 that affect the unfused marked media travel direction 116, or by making other adjustments to the apparatus 100. For example, the controller 150 can output alignment information corresponding to an angle between the fusing member axis of rotation 132 and the unfused marked media travel direction 116. The alignment information can be displayed to an operator who can use it to manually adjust the fusing member 130 or the unfused marked media travel direction 116 to make the fusing member axis of rotation 132 more perpendicular to the unfused marked media travel direction 116 and parallel with a media sheet leading edge. The operator can also use the alignment information to adjust the fusing member 130 or the unfused marked media travel direction 116 to make the alignment angle closer to a desired angle. The operator can make manual adjustments during a manufacturing process of the apparatus 100, during field setup of the apparatus 100, during maintenance of the apparatus 100, or at any other useful time.

According to a related embodiment, the apparatus 100 can include a media transport 110 configured to transport media in a travel direction substantially along a y-axis 101. The media travel direction can be substantially along the y-axis 101 because the travel direction of the media may not be exactly parallel with the y-axis 101. For example, the unfused marked media travel direction 116 may be at an angle to the y-axis 101. The apparatus 100 can include a media marking engine 120 coupled to the media transport 110. The media marking engine 120 can be configured to mark an image on media transported by the media transport 110 to create unfused marked media 115. The apparatus 100 can include a fusing member 130 coupled to the media transport 110. The fusing member 130 can have an axis of rotation 132 substantially parallel to an x-axis 102 perpendicular to the y-axis 101. The axis of rotation 132 can be substantially parallel to the x-axis 102 perpendicular to the y-axis 101 because the axis of rotation 132 may not be exactly parallel to the x-axis 102. The fusing member 130 can be or can include a rotating cylinder. The fusing member 130 can be configured to fuse the image on the media. The apparatus 100 can include a media motion sensor 140 configured to sense x-axis and y-axis travel information corresponding to an unfused marked media travel direction 116 and configured to output a media motion sensor signal corresponding to the x-axis and y-axis travel information.

The apparatus 100 can include a controller 150 coupled to the media motion sensor 140. The controller 150 can be configured to adjust an alignment angle between the fusing member axis of rotation 132 and the unfused marked media travel direction 116 based on the media motion sensor signal. The controller 150 can be configured to adjust the alignment angle between the fusing member axis of rotation 132 and the unfused marked media travel direction 116 to make the alignment angle between the fusing member axis of rotation 132 and the unfused marked media travel direction 116 closer to a desired angle. The controller 150 can be configured to adjust the alignment angle between the fusing member axis of rotation 132 and the unfused marked media travel direction 116 to make the alignment angle between the fusing member axis of rotation 132 and the unfused marked media travel direction 116 more of a right angle. The controller 150 can be configured to adjust the angle between the fusing member axis of rotation 132 and the unfused marked media travel direction 116 to make the angle between the fusing member axis of rotation 132 and the unfused marked media travel direction 116 closer to a desired angle that reduces wear on the fusing member 130.

For example, the unfused marked media 115 can travel in a travel direction 116 at a slight angle to the y-axis 101. The controller 150 can be configured to align fusing member 130 operation with the unfused marked media travel direction 116 based on the media motion sensor signal by adjusting the fusing member axis of rotation 132 to be more perpendicular to the unfused marked media travel direction 116 or by adjusting the unfused marked media travel direction 116 to be more perpendicular to the fusing member axis of rotation 132. The controller 150 can also make the alignment angle more of a desired angle to minimize wear on the fusing member 130, to adjust the unfused marked media 115 so a more desirable edge than another edge of the unfused marked media 115 passes through a desirable location of the fusing member 130, to bias the unfused marked media 115 to adjust media wear of the fusing member 130, to distribute media wear over a wider band of the fusing member 130, or to make the angle more desirable for any other purpose.

The apparatus 100 can include prime mover 160 coupled to the fusing member 130 and coupled to the controller 150. The controller 150 can be configured to control the prime mover 160 to adjust the alignment angle between the fusing member axis of rotation 132 and the unfused marked media travel direction 116 based on the media motion sensor signal. A prime mover can be a primary source of movement of the fusing member 130, such as an air cylinder, a drive motor and lead screw, a gear motor, a cam motor, a linear solenoid, or any other source of movement that can move the fusing member 130.

Figure 2:
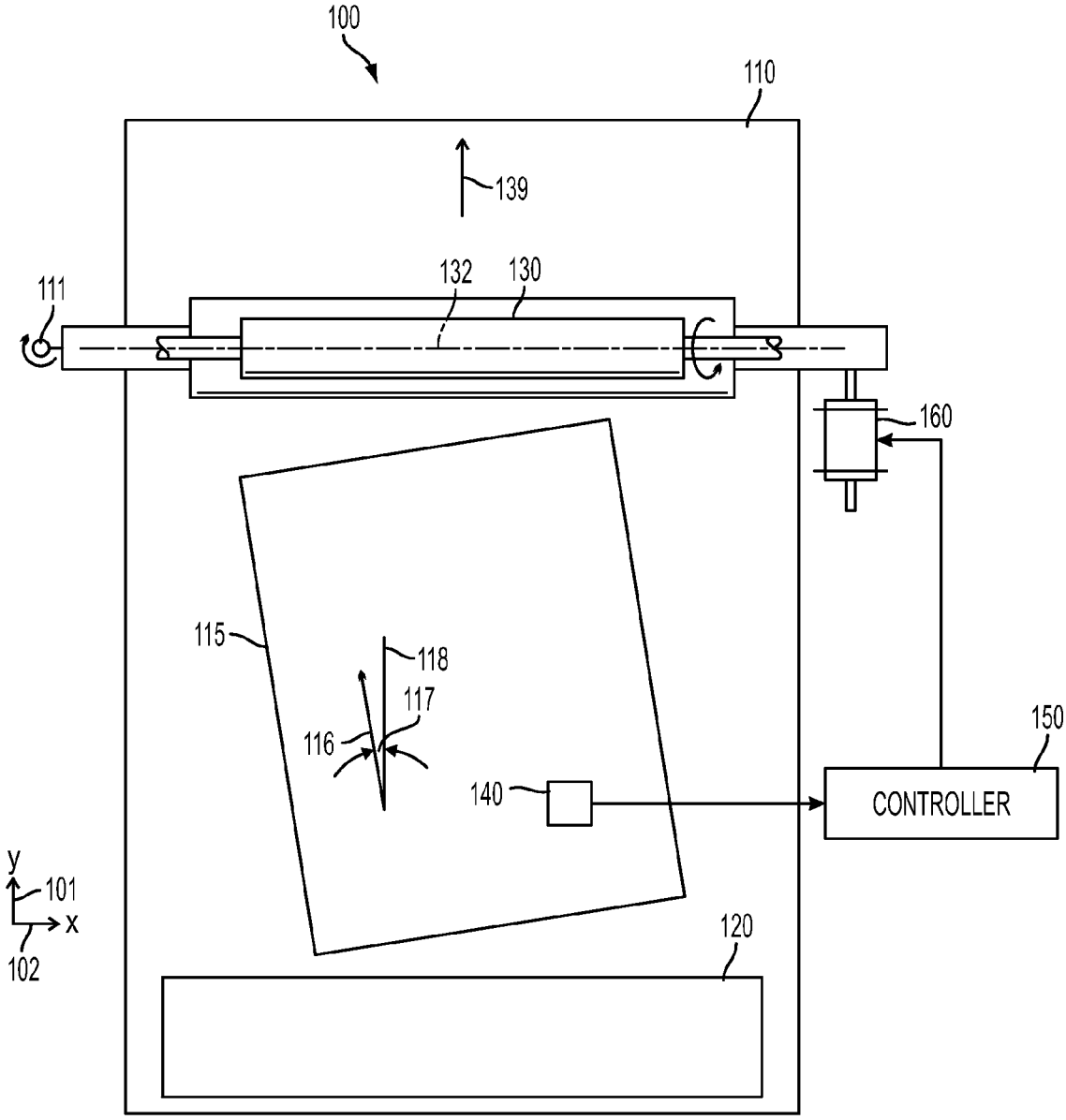
FIG. 2 is an exemplary illustration of an apparatus.

FIG. 2 is an exemplary illustration of the apparatus 100 according to a related embodiment. An unfused marked media travel direction 116 can be at an alignment angle 117 from an axis 118 perpendicular to the fusing member axis of rotation 132. The unfused marked media travel direction 116 can also be at an alignment angle from the fusing member axis of rotation 132. For example, the alignment angle 117 can be relative based on a relative point of reference. To elaborate, the alignment angle 117 can be an angle between the unfused marked media travel direction 116 and an axis 118 perpendicular to the fusing member axis of rotation 132, can be an angle between the unfused marked media travel direction 116 and the fusing member axis of rotation 132, can be an angle relative to the x-axis 102 or the y-axis 101, can be an angle between the unfused marked media travel direction 116 and the fusing member direction of operation 139, or can be any other angle relative to an unfused marked media travel direction 116 and a fusing member axis of rotation 132. The unfused marked media travel direction 116 and the alignment angle 117 may be exaggerated for purposes of illustration. For example, the alignment angle 117 may be closer to an angle of the y-axis 101, closer to the axis 118 perpendicular to the axis of rotation 132, and/or closer to an angle of the fusing member direction of operation 139.

The controller 150 can be configured to output an alignment angle signal to adjust the alignment angle 117 between the fusing member axis of rotation 132 and the unfused marked media travel direction 116 to make the alignment angle 117 closer to a desired angle. The controller 150 can also be configured to adjust the alignment angle 117 between the fusing member axis of rotation 132 and the unfused marked media travel direction 116 to make the alignment angle 117 more of a right angle. The controller 150 can also be configured to adjust the alignment angle 117 between the fusing member axis of rotation 132 and the unfused marked media travel direction 116 to make the alignment angle closer to a desired angle that reduces wear on the fusing member 130.

For example, the unfused marked media 115 can travel in a travel direction 116 at an alignment angle 117 in the media transport 110. The controller 150 can be configured to adjust the alignment angle 117 based on the media motion sensor signal by adjusting the fusing member axis of rotation 132 to be more perpendicular to the unfused marked media travel direction 116 or by adjusting the unfused marked media travel direction 116 to be more perpendicular to the fusing member axis of rotation 132. The controller 150 can also make the alignment angle 117 more of a desired angle to minimize wear on the fusing member 130, to adjust the unfused marked media 115 so a more desirable edge than another edge of the unfused marked media 115 passes through a desirable location of the fusing member 130, to bias the unfused marked media 115 to adjust media wear of the fusing member 130, to distribute media wear over a wider band of the fusing member 130, or to make the alignment angle 117 more desirable for any other purpose.

As a further example, the controller 150 may determine, based on the media motion sensor signal that the unfused marked media travel direction 116 is at an angle from an axis 118 perpendicular to the fusing member axis of rotation 132. The controller 150 can then align the unfused marked media travel direction 117 with the axis 118 perpendicular to the fusing member axis of rotation 132 by reducing or increasing the angle between the unfused marked media travel direction 116 and the axis 118 perpendicular to the fusing member axis of rotation 132.

Figure 3:
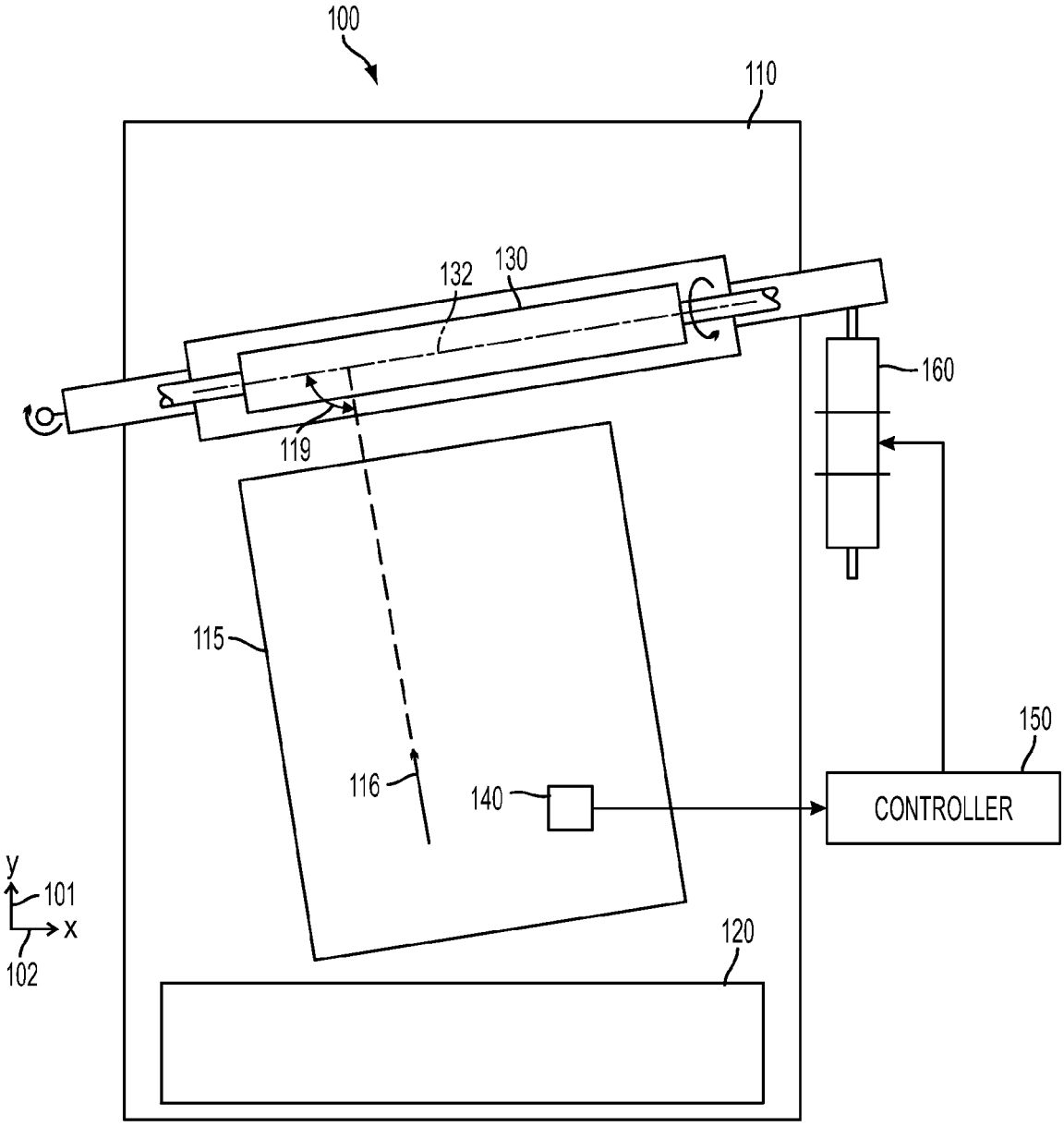
FIG. 3 is an exemplary illustration of an apparatus.

FIG. 3 is an exemplary illustration of the apparatus 100 according to a related embodiment. The controller 150 can be configured to control the prime mover 160 using the alignment angle signal to adjust an alignment angle 119 between the fusing member axis of rotation 132 and the unfused marked media travel direction 116 to make the alignment angle 119 closer to a desired angle. The fusing member 130 can also be adjusted, moved, or pivoted in any other manner. For example, a pivot point can be in the center of the fusing member 130 and the controller 150 can control the prime mover 160 to adjust an alignment angle 119 of the fusing member axis of rotation 132 relative to the unfused marked media travel direction 116. The controller 150 can also adjust, move, or pivot the fusing member 130 in any other manner useful for adjusting a fusing member 130. The unfused marked media travel direction 116 and the amount of adjustment of the fusing member 130 may be exaggerated for purposes of illustration and elements of the apparatus 100 are not necessarily drawn to scale.

Figure 4:
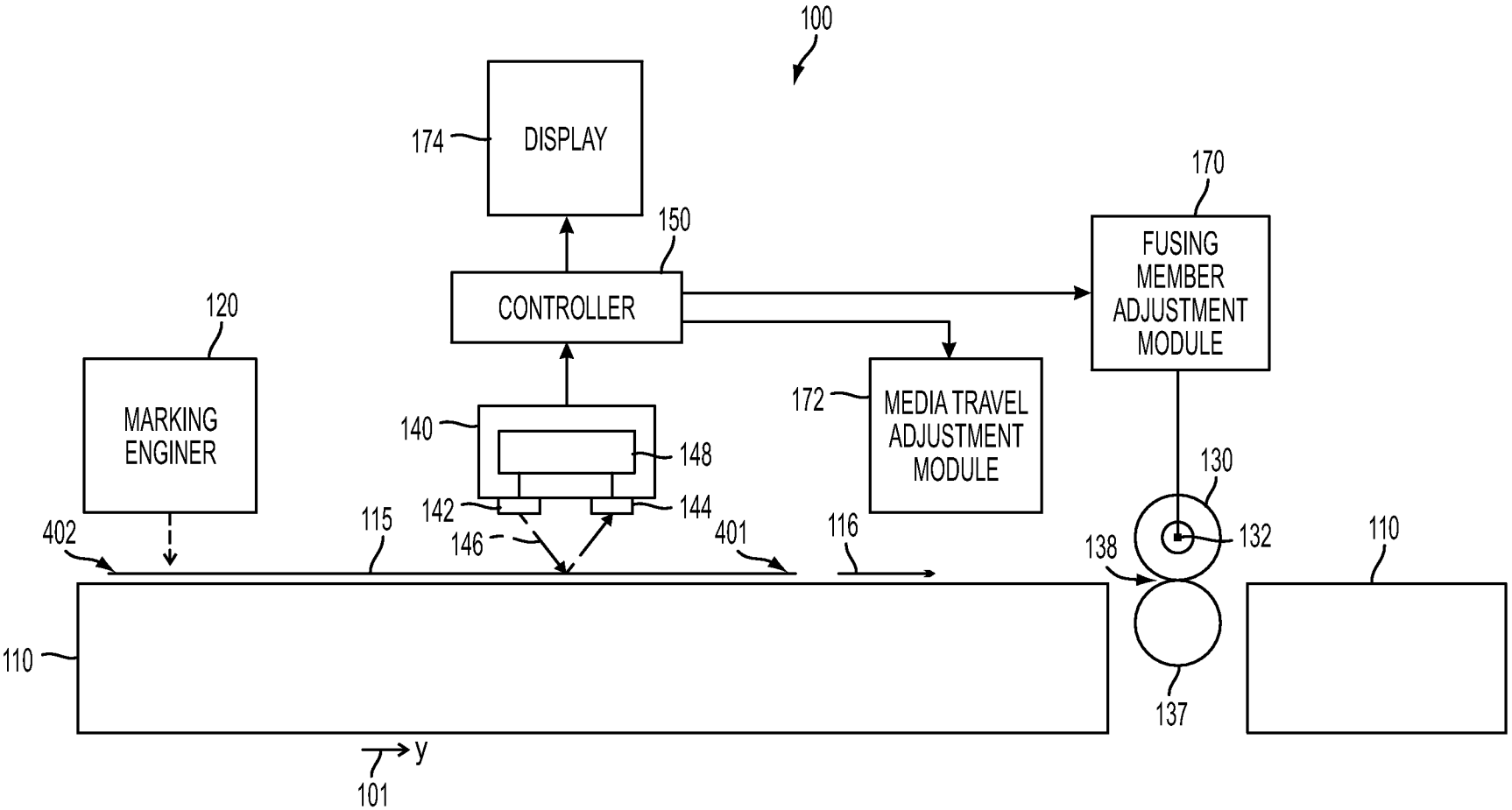
FIG. 4 is an exemplary illustration of an apparatus.

FIG. 4 is an exemplary illustration of the apparatus 100 according to a related embodiment. The apparatus 100 can include a pressure member 137 coupled to the fusing member 130 at a fusing nip 138 where the unfused marked media 115 can pass through the fusing nip 138. The pressure member 137 can be a roll, a belt, or any other pressure member that provides a pressure on media in contact with a heated surface of the fusing member 130. For example, a pressure roll can be cammed against the fusing member 130 to provide pressure to fix a toner powder image to media. The controller 150 can be configured to control a prime mover (not shown) to align operation of the fusing member 130 and the pressure member 137 with the unfused marked media travel direction 116.

The controller 150 can be configured to compare a media motion sensor signal corresponding to the unfused marked media travel direction 116 prior to the unfused marked media 115 reaching the fusing nip 138 with a media motion sensor signal corresponding to a media travel direction after the media enters the fusing nip 138. The controller 150 can be configured to output the alignment angle signal based on comparing the media motion sensor signal corresponding to the unfused marked media travel direction 116 prior to the unfused marked media 115 reaching the fusing nip with the media motion sensor signal corresponding to the media travel direction after the media enters the fusing nip.

The media motion sensor 140 can be located relative to the fusing member axis of rotation 132. One media motion sensor 140 can be used to detect a travel direction of a front area 401 of the unfused marked media 115 prior to the unfused marked media 115 entering the nip 138 and used to detect a travel direction of a back area 402 of the same unfused marked media 115 as or after the media has entered nip 138. Also, two or more sensors can be used to detect a travel direction of media before and after the media enters the nip 138 where at least one first sensor can be located before the nip 138 and at least one second sensor (not shown) can be located after the nip 138. The controller 150 can compare a media motion sensor signal prior to the unfused marked media 115 reaching the fusing nip 138 with a media motion sensor signal after fused media enters or exits the fusing nip 138 to determine if a media travel direction has changed or is changing as the media has exited the fusing nip 138, while the media is in the fusing nip 138, or after the media has exited the fusing nip 138.

The controller 150 can also be configured output the alignment angle signal to adjust, after media marking, skew of the unfused marked media 115 relative to the fusing member axis of rotation 132. For example, a media registration process can use nip wheels and other elements to adjust media sheets to desired positions for accurate transportation, marking, fusing, output, and other registration purposes. The controller 150 can adjust skew of media after media registration or after both media registration and marking. The controller 150 can adjust the skew of the media by adjusting elements of the media transport 110 that affect the skew of the media, by adjusting the media itself, of by making other adjustments that affect the skew of media.

The media motion sensor 140 can include an optical transmitter 142 configured to transmit light 146 at the unfused marked media 115. The media motion sensor 140 can include an optical receiver 144 configured to receive light 146 transmitted by the optical transmitter 142 reflected off the unfused marked media 115. The media motion sensor 140 can include a sensor controller 148 configured to translate light 146 received by the optical receiver 144 into motion of the unfused marked media 115 and configured to output the media motion sensor signal based on the motion of the unfused marked media 115. The optical transmitter 142 can be a light emitting diode, an infrared transmitter, a laser, a laser interferometer, a dual-laser configuration, or any other useful optical transmitter. The optical receiver 144 can be a camera, a light sensor, a complimentary metal-oxide semiconductor sensor, a photodiode sensor, or any other useful optical receiver. The media motion sensor 140 may include other elements useful for detecting the motion of media. For example, the media motion sensor 140 may include a ball that can contact the media. The ball may be located on a side of the media opposite from the marked side of the media. The sensor controller can detect ball movement and can translate the ball movement into motion of the media. According to another example, an optical transmitter and an optical receiver can be used to detect ball movement when a ball that contacts the media.

The apparatus 100 can include a fusing member adjustment module 170 coupled to the controller 150. The controller 150 can be configured to provide the alignment angle signal to the fusing member adjustment module 170 and the fusing member adjustment module 170 can be configured to adjust the fusing member to adjust the alignment angle between the fusing member axis of rotation 132 and the unfused marked media travel direction 116 based on the alignment angle signal. The apparatus 100 can include a media travel adjustment module 172 coupled to the controller 150. The controller 150 can be configured to provide the alignment angle signal to the media travel adjustment module 172 and the media travel adjustment module 172 can be configured to adjust media travel to adjust an angle between the fusing member axis of rotation 132 and an unfused marked media travel direction 116 based on the alignment angle signal. The apparatus 100 can include a display 174 coupled to the controller 150. The controller 150 can be configured to provide the alignment angle signal to the display 174 and the display 174 can be configured to display information regarding the alignment angle between the fusing member axis of rotation 132 and the unfused marked media travel direction 116 based on the alignment angle signal.

Figure 5:
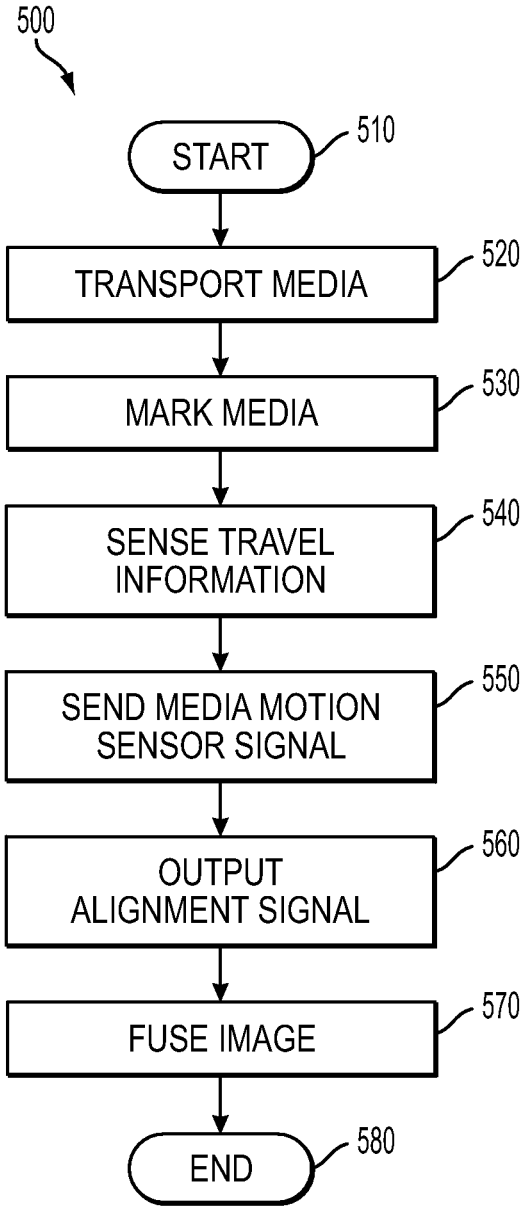
FIG. 5 illustrates an exemplary flowchart of a method for detecting the travel direction of media in an apparatus.

FIG. 5 illustrates an exemplary flowchart 500 of a method for detecting the travel direction of media in an apparatus having a media transport, a media marking engine, and a fusing member having an axis of rotation, the apparatus also including a media motion sensor and a controller. The method can be performed during manufacturing, during setup of the apparatus, during maintenance of the apparatus, during normal apparatus operation, or at any other useful time. The method starts at 510. At 520, media is transported in the media transport. At 530, an image is marked, using the media marking engine, on the media transported in the media transport to create unfused marked media. At 540, travel information of the unfused marked media is sensed using the media motion sensor. At 550, a media motion sensor signal is sent from the media motion sensor to the controller, where the media motion sensor signal corresponds to the unfused marked media travel information. At 560, the controller outputs an alignment angle signal in response to receiving the media motion sensor signal. The alignment angle signal can correspond to an alignment angle between the fusing member axis of rotation and the unfused marked media travel direction. At 570, the fusing member fuses the image on the media. At 580, the method ends.

Figure 6:
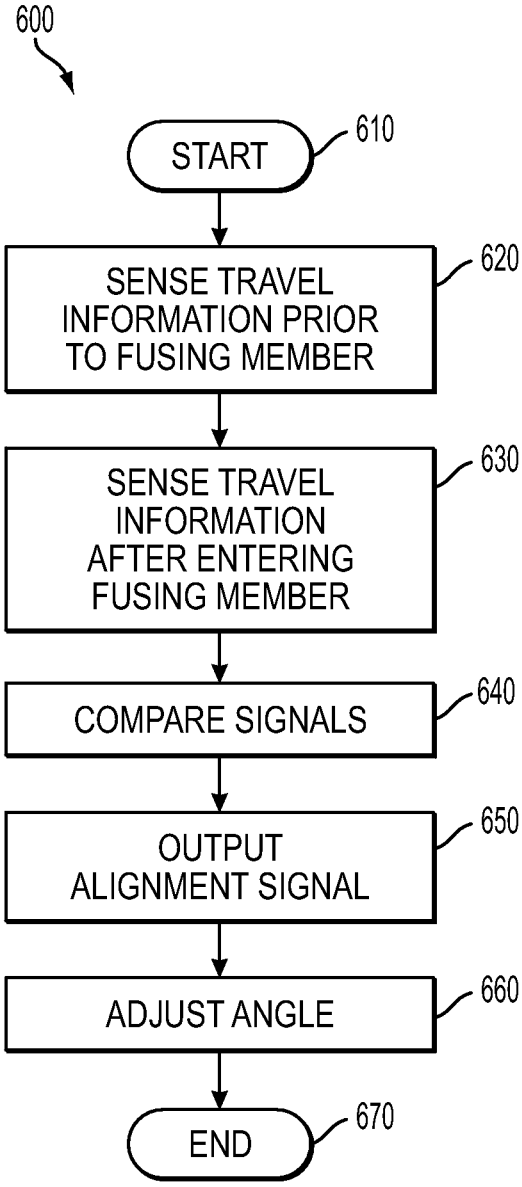
FIG. 6 illustrates an exemplary flowchart of a method for detecting the travel direction of media in an apparatus.

FIG. 6 illustrates an exemplary flowchart 600 of a method for detecting the travel direction of media in an apparatus. Elements of the flowchart 600 can be used with the flowchart 500. The method starts at 610. At 620, travel information of unfused marked media prior to the unfused marked media reaching the fusing member is sensed to generate a corresponding media motion sensor signal. At 630, travel information the media after the media contacts the fusing member is sensed to generate a corresponding media motion sensor signal. At 640, a media motion sensor signal corresponding to the unfused marked media prior to the unfused marked media reaching the fusing member is compared with a media motion sensor signal corresponding to the media after the media contacts the fusing member. At 650 an alignment angle signal regarding an alignment angle between the fusing member axis of rotation and a media travel direction is output based on comparing the media motion sensor signal corresponding to the unfused marked media prior to the unfused marked media reaching the fusing member with the media motion sensor signal corresponding to the media after the media contacts the fusing member. At 660, an angle between the fusing member axis of rotation and the media travel direction is adjusted based on the alignment angle signal to make the angle between the fusing member axis of rotation and the media travel direction closer to a desired angle. The angle can be adjusted by adjusting an orientation of the fusing member, by adjusting the media travel direction, by adjusting both the orientation of the fusing member and the media travel direction, or by adjusting other elements of the apparatus. At 670, the method ends.

Figure 7:
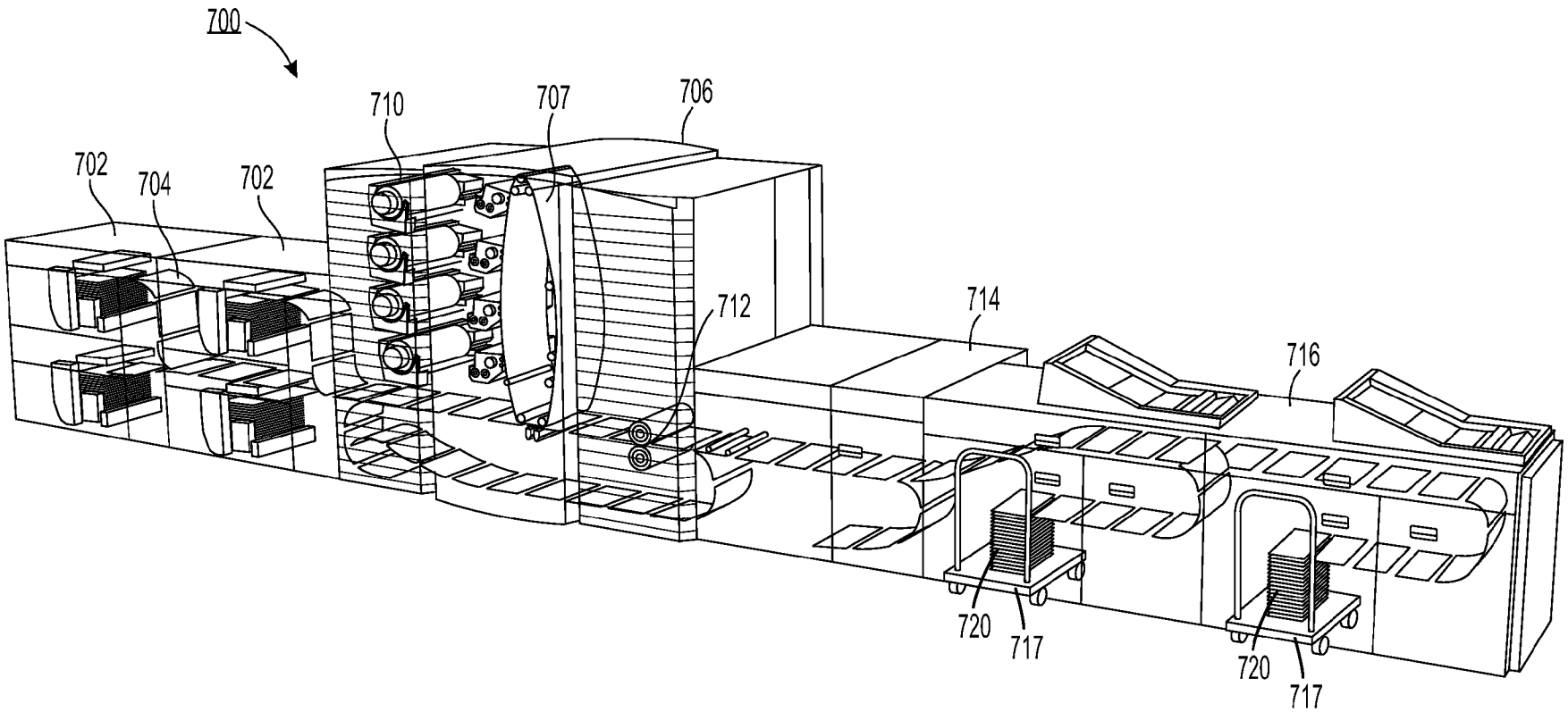
FIG. 7 illustrates an exemplary printing apparatus.

FIG. 7 illustrates an exemplary printing apparatus 700, such as the apparatus 100. As used herein, the term "printing apparatus" encompasses any apparatus, such as a digital copier, bookmaking machine, multifunction machine, or other printing device that performs a print outputting function for any purpose. The printing apparatus 700 can be used to produce prints from various media, such as coated, uncoated, previously marked, plain paper sheets, or other media. The media can have various sizes and weights. In some embodiments, the printing apparatus 700 can have a modular construction. As shown, the printing apparatus 700 can include at least one media feeder module 702, a printer module 706 adjacent the media feeder module 702, an inverter module 714 adjacent the printer module 706, and at least one stacker module 716 adjacent the inverter module 714.

In the printing apparatus 700, the media feeder module 702 can be adapted to feed media 704 having various sizes, widths, lengths, and weights to the printer module 706. In the printer module 706, which can include the marking engine 120, toner is transferred from an arrangement of developer stations 710 to a charged photoreceptor roll or belt 707 to form toner images on the photoreceptor roll or belt 707. The toner images are transferred to the media 704 fed through a paper path, such as the media transport 110. The media 704 are advanced through a fuser 712, which can include the fusing member 130, adapted to fuse the toner images on the media 704. The inverter module 714 manipulates the media 704 exiting the printer module 706 by either passing the media 704 through to the stacker module 716, or by inverting and returning the media 704 to the printer module 706. In the stacker module 716, the printed media 704 are loaded onto stacker carts 717 to form stacks 720.

Embodiments can minimize the misalignment between a media motion and/or travel direction and the fuser roll axis to minimize the cutting and or wiping action of the media as it passes through the fuser nip. Embodiments can include a motion sensor, feeding both x-axis and y-axis media travel information, a prime mover that adjusts the fuser alignment to the media, and a control system to control the position of the fuser based upon the sensor signal and to control the ability to align the fuser to media travel motion.

Some embodiments can fix a fuser assembly at one end and provide a prime mover to adjust the opposite end of the fuser assembly so the fuser roll axis can be moved relative to a media alignment direction. These embodiments can make the fuser steerable and the axis of the fuser roller can be adjusted to achieve perpendicularly with the media path.

According to some embodiments, the use of an optical paper motion sensor can provide the true vector of paper motion. Both y-axis process direction velocity and x-axis cross-process direction velocity can be supplied and then used to calculate the travel angle of the media. Travel angle information can be fed back to a fuser location adjuster, which can adjust the fuser roll axis to square it to the media travel direction prior to the media arrival at the fuser nip. This process can correct the paper angle relative to the fuser.

According to some embodiments, the sensor can be used as a field set up tool, to determine the angle and the fuser can be manually adjusted to achieve better alignment. Also, the media travel direction prior to entering the nip can be compared with the media travel direction after media is in the nip and the fuser position can be adjusted to minimize the shift in direction due to misalignment.

Some embodiments can compensate for the skew induced by an anti-wrinkle flair built into a fuser system where the pressure roller is larger on the ends then in the middle. Such anti-wrinkle compensation can lead to the fuser passing media sheets through at the edges faster than in the center, which can stretch out the sheets to prevent wrinkle in moisture damaged sheets. However, since the sheet is edge registered, having too much anti-wrinkle flair on narrow media can lead to problems on wide sheets with a non-uniform velocity profile within the nip, where the flair is reduced at the non-registered end from the ideal except for the widest sheets. The non-uniform flair can lead to skewing of the sheets in the nip when narrow media is passed. This can also increase the edge wear damage of the fuser roll. Embodiments can adjust the amount of skew compensation based upon media width. For example, for wide media, full correction can be made. For narrower media, a compromise angle can be used to compensate for the anti-wrinkle skew induced in the travel path.

Embodiments may preferably be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. An apparatus comprising:

a media transport configured to transport media;

a media marking engine coupled to the media transport, the media marking engine configured to mark an image on media transported by the media transport to create unfused marked media;

a fusing member coupled to the media transport, the fusing member being a first roller member having an axis of rotation, the fusing member configured to fuse the image on the media;

a pressure member being a second roller member coupled to the fusing member at a fusing nip through which the unfused marked media passes for fusing, the pressure member having an axis of rotation parallel to the axis of rotation the fusing member;

a prime mover coupled to the fusing member, the prime mover being configured to adjust a position of the fusing member and the pressure member with respect to an unfused marked media travel direction;

a media motion sensor disposed downstream of the media marking engine and configured to sense travel information based on the unfused marked media travel direction, the unfused marked media travel direction deviating from a longitudinal axis of a portion of the media transport between the media marking engine and the fusing member, and configured to output a media motion sensor signal corresponding to the travel information; and a controller coupled to the media motion sensor, the controller being configured to output an alignment angle signal in response to receiving the media motion sensor signal, the alignment angle signal corresponding to an alignment angle between the fusing member axis of rotation and the unfused marked media travel direction, the controller being coupled to the prime mover and configured to control the prime mover using the alignment angle signal to adjust the alignment angle between the fusing member axis of rotation and the unfused marked media travel direction to maintain the alignment angle consistently at a right angle, and the fusing member including a first end and a second end, the apparatus further comprising a pivot point to which the first end of the fusing member is coupled, the prime mover being coupled to the second end of the fusing member.

2. The apparatus according to claim 1, the controller being further configured to compare a first media motion sensor signal corresponding to the unfused marked media travel direction prior to the unfused marked media reaching the fusing nip with a second media motion sensor signal corresponding to a media travel direction after the media enters the fusing nip, and to output the alignment angle signal based on comparing the media motion sensor signal corresponding to the unfused marked media travel direction prior to the unfused marked media reaching the fusing nip with the media motion sensor signal corresponding to the media travel direction after the media enters the fusing nip.

3. The apparatus according to claim 1, wherein the controller is configured output the alignment angle signal to adjust, after media marking, the fusing member axis of rotation to match a skew of the unfused marked media.

4. The apparatus according to claim 1, wherein the media motion sensor includes:

an optical transmitter configured to transmit light at the unfused marked media;

an optical receiver configured to receive light transmitted by the optical transmitter reflected off the unfused marked media; and a sensor controller configured to translate light received by the optical receiver into motion of the unfused marked media and configured to output the media motion sensor signal based on the motion of the unfused marked media.

5. The apparatus according to claim 1, further comprising a display coupled to the controller, the controller being configured to provide the alignment angle signal to the display and the display being configured to display information regarding the alignment angle between the fusing member axis of rotation and the unfused marked media travel direction based on the alignment angle signal.

6. An apparatus comprising:

a media transport configured to transport media in a travel direction substantially along a y-axis;

a media marking engine coupled to the media transport, the media marking engine configured to mark an image on media transported by the media transport to create unfused marked media;

a fusing member coupled to the media transport, the fusing member being a first roller member having an axis of rotation, which, in a first position, is substantially parallel to an x-axis perpendicular to the y-axis, the fusing member including a rotating cylinder, the fusing member configured to fuse the image on the media;

a pressure member being a second roller member coupled to the fusing member at a fusing nip through which the unfused marked media passes for fusing, the pressure member having an axis of rotation parallel to the axis of rotation the fusing member;

a prime mover coupled to the fusing member, the prime mover being configured to adjust a position of the fusing member and the pressure member with respect to an unfused marked media travel direction;

a media motion sensor disposed downstream of the media marking engine and configured to sense x-axis and y-axis travel information corresponding to the unfused marked media travel direction, the unfused marked media travel direction deviating from the y-axis that is a longitudinal axis of a portion of the media transport between the media marking engine and the fusing member, and configured to output a media motion sensor signal corresponding to the x-axis and y-axis travel information; and a controller coupled to the media motion sensor, the controller being configured to adjust an alignment angle between the fusing member axis of rotation and the unfused marked media travel direction based on the media motion sensor signal, the controller being coupled to the prime mover and configured to control the prime mover based on the media motion sensor signal to adjust the alignment angle between the fusing member axis of rotation and the unfused marked media travel direction to maintain the alignment angle consistently at a right angle, and the fusing member including a first end and a second end, the apparatus further comprising a pivot point to which the first end of the fusing member is coupled, the prime mover being coupled to the second end of the fusing member.

7. A method in an apparatus including a media transport, a media marking engine, and a fusing member being a roller member having an axis of rotation, the apparatus also including a media motion sensor and a controller, the method comprising:

transporting media in the media transport;

marking, with the media marking engine, an image on the media transported in the media transport to create unfused marked media;

sensing, using the media motion sensor, travel information of the unfused marked media downstream of the media marking engine, the media motion sensor being positioned downstream of the media marking engine, the unfused marked media travel direction deviating from a longitudinal axis of a portion of the media transport between the media marking engine and the fusing member;

sending a media motion sensor signal to the controller, the media motion sensor signal corresponding to the unfused marked media travel information;

outputting, with the controller, an alignment angle signal in response to receiving the media motion sensor signal, the alignment angle signal corresponding to an alignment angle between the fusing member axis of rotation and the unfused marked media travel direction;

maintaining the alignment angle between the fusing member axis of rotation and the unfused marked media travel direction at a right angle; and fusing, using the fusing member, the image on the media, the controller being coupled to a prime mover which is in turn mechanically coupled to the fusing member, the prime mover being configured to adjust a position of the fusing member with respect to the unfused marked media travel direction, and the fusing member including a first end and a second end, the first end of the fusing member being coupled to a pivot point and the prime mover being coupled to the second end of the fusing member.

8. The method according to claim 7, further comprising:

comparing a media motion sensor signal corresponding to the unfused marked media prior to the unfused marked media reaching the fusing member with a media motion sensor signal corresponding to the media after the media contacts the fusing member, wherein outputting comprises outputting an alignment angle signal regarding an alignment angle between the fusing member axis of rotation and a media travel direction based on comparing the media motion sensor signal corresponding to the unfused marked media prior to the unfused marked media reaching the fusing member with the media motion sensor signal corresponding to the media after the media contacts the fusing member.

* * * * *